United States Patent [19]

Wright et al.

[11] Patent Number: 4,557,681

[45] Date of Patent: Dec. 10, 1985

[54] APPARATUS FOR FORMING ADOBE BLOCKS

[75] Inventors: John W. Wright, Box 7395, Grants, N. Mex. 87020; Jack L. Elkins, Grants, N. Mex.

[73] Assignee: John W. Wright, Grants, N. Mex.

[21] Appl. No.: 368,443

[22] Filed: Apr. 14, 1982

[51] Int. Cl.[4] ..... B28B 5/08

[52] U.S. Cl. ..... 425/62; 425/350; 425/361

[58] Field of Search ..... 425/361, 62, 73, 75, 425/348 R, 350, 416, 422, 434, 444

[56] References Cited

U.S. PATENT DOCUMENTS

| | | | |
|---|---|---|---|
| 266,532 | 10/1882 | Ross | 425/361 |
| 435,171 | 8/1890 | Davis et al. | 425/361 |
| 686,656 | 11/1901 | Hoban | 425/361 X |
| 836,547 | 11/1906 | Walsh | 425/73 |
| 1,335,071 | 3/1920 | Moussette | 425/452 |
| 2,560,980 | 7/1957 | Pettersen | 425/361 |
| 3,225,409 | 12/1965 | Huffaker | 425/62 X |
| 3,956,516 | 5/1976 | Holt et al. | 425/361 X |

*Primary Examiner*—Jay H. Woo
*Assistant Examiner*—James C. Housel
*Attorney, Agent, or Firm*—Harvey B. Jacobson

[57] ABSTRACT

A rotary table is provided defining at least three peripherally spaced open-ended vertically extending sleeve-type cavities spaced equally radially outwardly from and about the axis of rotation of the table and a soil receiving chamber is stationarily supported and opens downwardly in a location with which the upper portions of the cavities are successively closely registrable from beneath upon angular displacement of the table. The chamber is disposed at a first stationary station and second and third stationary stations are also defined about the axis in position for registry with second and third cavities of the table when the first cavity thereof is registered with the soil receiving chamber. The second station has a hydraulic ram supported therefrom for downward displacement into and upward retraction from a rotary table cavity registered therewith from beneath and the third station has a hydraulical ram mounted downwardly extendible and upwardly retractable ejection head supported therefrom for downward displacement into and upward retraction from the rotary table cavity registered therewith. The rotary table is supported from a frame including a spring extended and hydraulically retracted latch pin for coaction with peripheral latch keeper notches formed in the rotary table equal in number to the table cavities and spaced relative to the latter whereby seating of the latch pin in successive notches will key successive cavities of the table in registry with the soil receiving chamber, the ram and the ejection head.

5 Claims, 6 Drawing Figures

FIG. 1
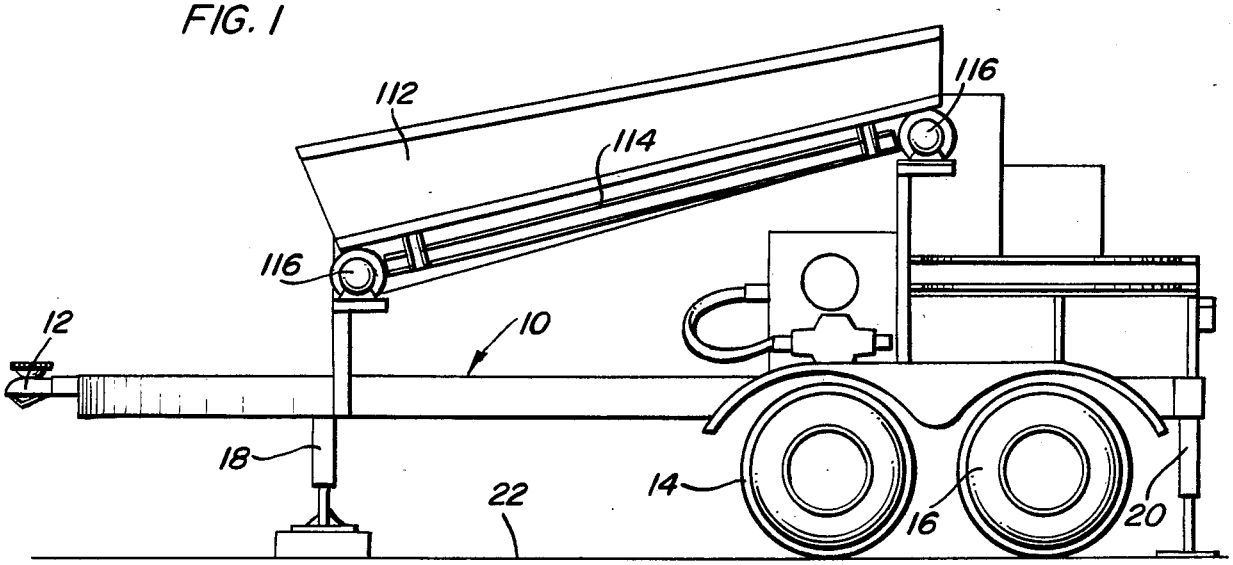
FIG. 6
FIG. 2
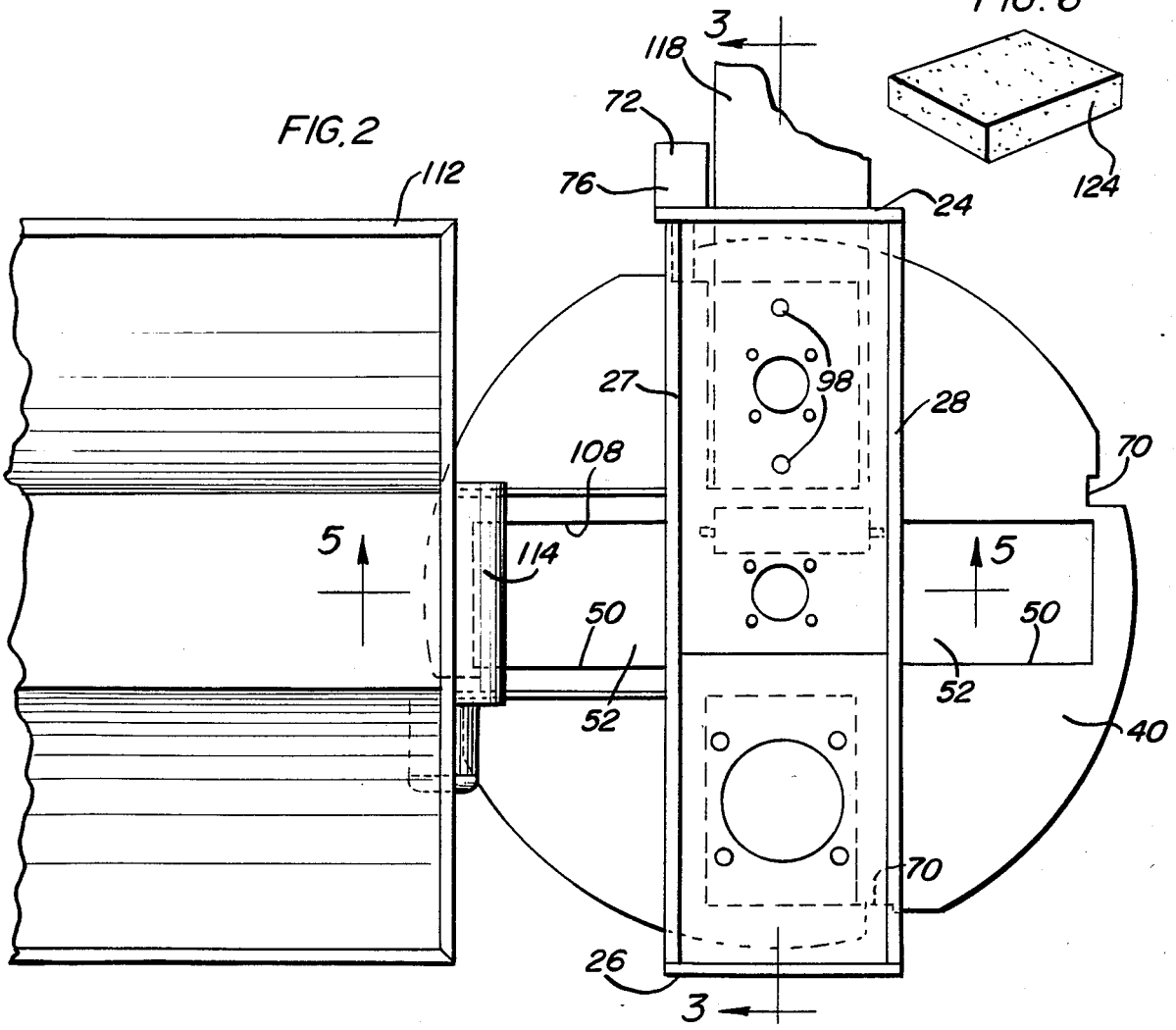

FIG. 3
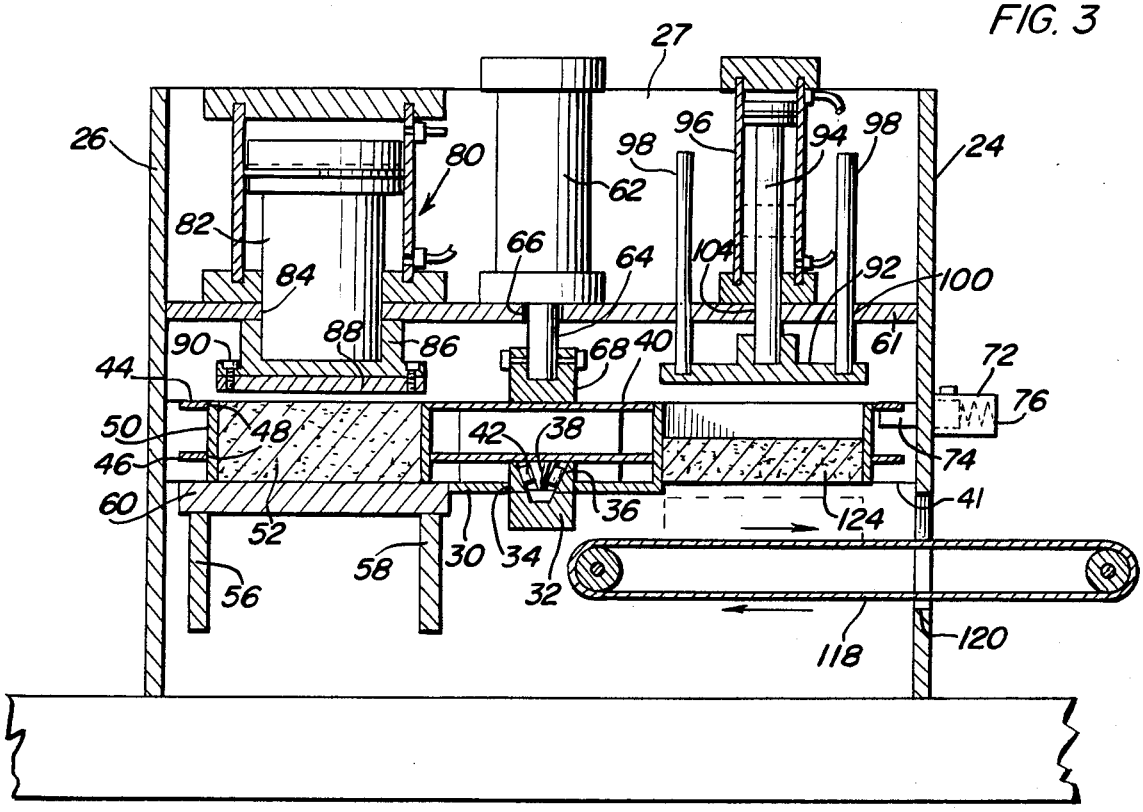
FIG. 4
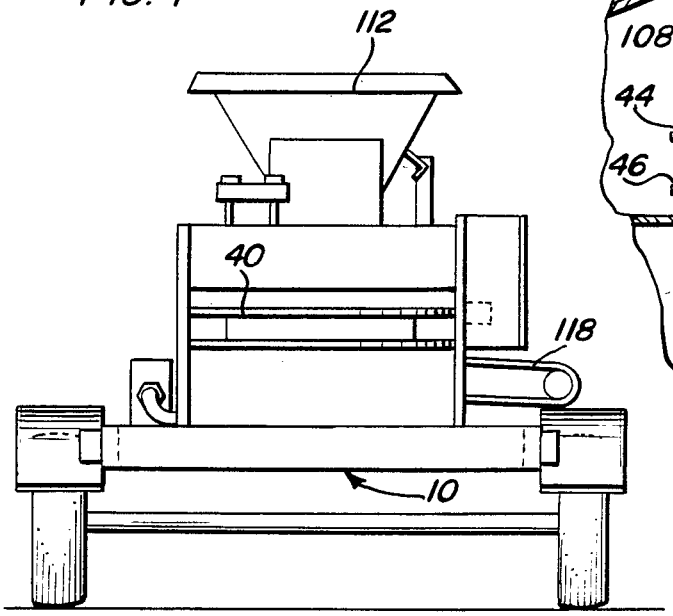
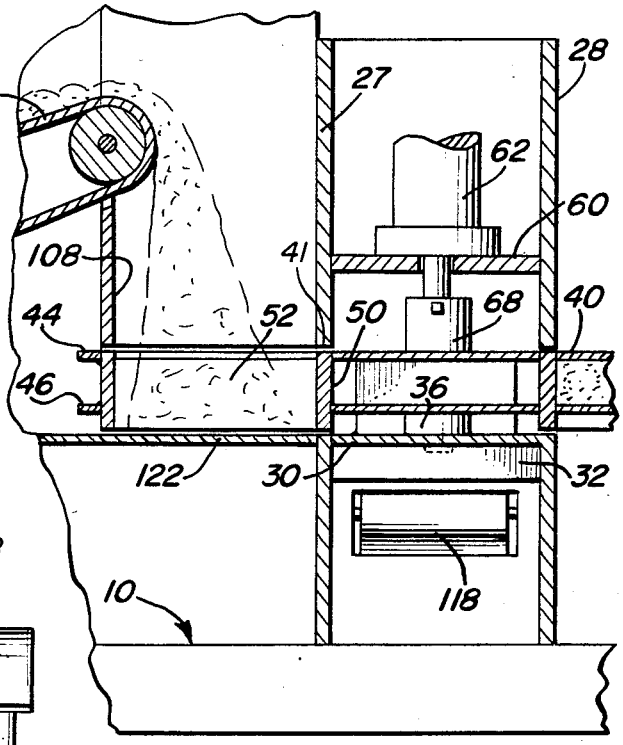
FIG. 5

APPARATUS FOR FORMING ADOBE BLOCKS

BACKGROUND OF THE INVENTION

Various forms of presses heretofore have been provided for forming adobe block from suitable heavy textured clay soil and the like. However, some of these presses are manually operable and thus limited in the amount of pressure which may be applied thereby and other previously known presses are constructed in a manner whereby high capacity output is deterred. Accordingly, a need exists for a powered press constructed in a manner whereby high compression forces may be developed and wherein the press is constructed in a manner to facilitate high capacity operation.

Examples of previously known forms of presses including some of the general structural and operational features of the instant invention are disclosed in U.S. Pat. Nos. 2,121, 143,806, 266,532, 348,617, 348 702, 435,171 and 1,335,071.

SUMMARY OF THE INVENTION

The apparatus of the instant invention is constructed on a mobile trailer chassis whereby it may be readily transported to a point of use and in particular to a point immediately adjacent the building site.

The apparatus is further constructed whereby high volume production of adobe blocks may be readily achieved and the quality of adobe block produced by the apparatus is considerably greater than that which is required in the construction of adobe buildings in substantially all locations in which adobe buildings are presently constructed.

The apparatus is capable of generating pressure sufficiently great to enable high quality adobe building blocks to be formed of heavy textured clay soil in the condition it is dug from the ground and without the addition of any moisture or binder materials. Further, the adobe blocks produced by the apparatus of the instant invention need not be air-dried before usage and thus may be immediately placed in a building wall upon being discharged from the apparatus in which they are formed. Still further, when constructing an adobe wall utilizing the blocks produced by the apparatus of the instant invention, the upper surface of each course of adobe blocks is dampened before the next course of adobe blocks is placed thereover. In this manner, the smooth and planar upper and lower surfaces of the adobe blocks may bind tightly together merely through the utilization of the moisture applied only to the upper surfaces of the block of each course of blocks.

The main object of this invention is to provide an apparatus for forming adobe blocks which will greatly reduce the man hours of labor required to produce 1,000 blocks.

Another object of this invention is to provide an apparatus which will be capable of forming adobe blocks of high quality and at high volume rates.

Yet another object of this invention is to provide an apparatus for forming adobe blocks which may utilize heavy textured clay soil as the material for the adobe blocks being formed and without mixing a binder material with the soil and merely supplying fresh dug heavy textured clay soil directly to the apparatus.

A still further object of this invention is to provide an apparatus which will be capable of forming adobe blocks in high quantities and with the blocks formed by the apparatus being immediately usable in a building wall without any "drying time".

A final object of this invention to be specifically enumerated herein is to provide an apparatus for forming adobe building blocks and which will conform to conventional forms of manufacture, be of simple construction and easy to use, so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a side elevational view of a tandem axle trailer mounted form of the instant invention;

FIG. 2 is an enlarged schematic top plan view of the right hand portion of the assemblage illustrated in FIG. 1;

FIG. 3 is a vertical sectional view taken substantially upon the plane indicated by the section line 3—3 of FIG. 2;

FIG. 4 is a rear elevational view of the assemblage illustrated in FIG. 1 as seen from the right side thereof;

FIG. 5 is a fragmentary vertical sectional view taken substantially upon the plane indicated by the section line 5—5 of FIG. 2; and FIG. 6 is a perspective view of an adobe block produced through the apparatus of the instant invention.

DETAILED DESCRIPTION OF THE INVENTION

Referring now more specifically to the drawings, the numeral 10 generally designates a trailer frame including a towing hitch 12 on its forward end, a pair of wheeled axle assemblies 14 and 16 (tandem) on its rear end and a single forward jack structure 18 and a pair of opposite side rear jack structures 20, the jack structures 18 and 20 being downwardly extendible into engagement with the ground 22 upon which the axle assemblies 14 and 16 rest in order to stationarily support the trailer frame from the ground.

The frame 10 supports a pair of opposite side upstanding plates 24 and 26 therefrom and the plates 24 and 26 are interconnected through the utilization of a pair of front and rear upstanding plates 27 and 28 secured therebetween. A central lower plate 30 extends and is secured between the plates 27 and 28 and is reinforced by an underlying bracing bar 32 also extending and secured between the plates 27 and 28. The central portion of the lower plate 30 has an opening 34 formed therein and a bearing block 36 is secured within the opening 34 and is backed from beneath by the bar 32. The bearing block 36 journals a depending stub shaft portion 38 of a rotary table 40 through the utilization of combined thrust and journal bearings 42 opposite side portions of the table 40 being swingable through openings 41 formed in the plates 27 and 28.

The table 40 includes upper and lower generally circular plates 44 and 46 including four sets of vertically registered openings 52 formed therein and spaced equally peripherally thereabout at equal distances from the axis of rotation of the shaft portion 38. Each set of registered openings has an upstanding sleeve 50 secured therethrough defining a rectangular cavity 52 open at its top and open at its bottom. The upper end of each cavity 52 is flush with the upper surface of the upper plate 44 and the lower end of each cavity 52 projects somewhat below the undersurface of the lower plate 46.

A pair of support plates 56 and 58 extend between the plates 27 and 28 below the level of the lower plate 30 and removably support a thick backing plate 60 therefrom. The backing plate 60 is removably supported from the plates 56 and 58 in any convenient manner and is horizontally removable through an opening (not shown) formed in one of the plates 27 and 28.

The cavities are relatively angularly displaced 90° about the axis of rotation of the table 40 and an upper support plate 61 is secured between the plates 24, 26, 27 and 28 and mounts the lower end of a rotary fluid motor 62 therefrom. The rotary motor 62 includes a depending rotary output shaft 64 which projects downwardly through a central opening 66 formed in the plate 61 and the output shaft 64 is keyed to an upper central fitting 68 carried by the upper plate 44. Accordingly, the motor 62 may intermittantly angularly displace the rotary table 40.

The upper plate 44 includes four peripherally spaced notches 70 spaced equally thereabout and the plate 24 mounts a latch assembly 72 therefrom including a spring extendible latch pin 74 and a hydraulic cylinder 76 for hydraulically retracting the latch pin 74. The latch assembly 72 may be connected to any suitable source of hydraulic fluid under pressure through an appropriate manual or automatically actuated valve.

The plate 61 supports a high pressure ram assembly referred to in general by the reference numeral 80 and the ram assembly 80 includes a downwardly extendible and upwardly retractable piston 82 which extends downwardly through an opening 84 provided therefor in the plate 61 and has a head 86 supported from its lower end below the plate 61. The head 86 mounts a pressure plate 88 from the underside thereof through the utilization of removable fasteners 90. In addition, an ejection head 92 is mounted on the lower end of the piston 94 of a second less powerful ram assembly 96 also supported from the plate 61. The ejection head 92 includes a pair of upstanding guide pins 98 supported therefrom and the guide pins 98 are received through guide bores 100 formed in the plate 61, while the ram 96 includes a piston 94 which is slidably received through an opening 104 formed in the plate 61 and has the ejection head 92 mounted on its lower end.

The ram assemblies 80 and 96 are angularly displaced 180° apart about the axis of rotation of the table 40 and angularly displaced 90° in opposite directions about the axis of rotation of the table 40 from a soil receiving chamber 108 stationarily mounted above the forward periphery of the rotary table 40. The lower end of the soil receiving chamber 108 is registered with the upper end of one of the cavities 52 when the latch pin 74 is seated in one of the notches 70. At the same time one of the cavities 52 is registered with the lower end of the soil receiving chamber 108, second and third cavities 52 are registered with the heads 86 and 92. The trailer frame 10 includes an elevated inclined soil receiving hopper 112 which extends longitudinally of the trailer frame 10 and includes a bottom defined by an endless conveyor 114 whereby dirt placed within the hopper 112 may be conveyed upwardly therealong. The upper end of the endless conveyor 114 is disposed within the soil receiving chamber 108. Thus, the conveyor 114 is operative to supply soil to the soil receiving chamber 108 from the hopper 112. The endless conveyor 114 may be powered by hydraulic motors 116 from the aforementioned source of hydraulic fluid under pressure and the rams 80 and 96 may also receive hydraulic fluid under pressure from the same source through suitable manually or automatically controlled valves. Further, an endless discharge conveyor 118 is supported between the plates 27 and 28 and includes one end thereof disposed beneath the ram 96 and a second end thereof which projects outwardly through an opening 120 formed in the plate 24. The endless conveyor 118 is operable to receive adobe blocks 124 displaced downwardly from one of the cavities 52 by the ejection head 92.

In operation, freshly dug soil is dumped into the hopper 112 and the endless conveyor 114 is operative to convey soil from the hopper 112 into the chamber 108. The soil discharged into the chamber 108 falls by gravity down into the cavity 52 registered therebeneath and closed at its lower end by a stationary horizontal plate 122. After the cavity 52 registered with the chamber 108 has been filled with soil, the motor 62 is either manually or automatically operated in order to angularly displace the rotary table 40 in a counterclockwise direction as viewed in FIG. 2 of the drawings to move the cavity 52 just filled with soil into registry with the head 86 and to swing the next empty cavity 52 in registry with the chamber 108 for gravity receiving soil. As the first filled cavity 52 registers with the head 86, the latch pin 74 latches the table 40 in position and the hydraulic ram 80 is actuated to compress the soil into a hard adobe block. The pressure which may be exerted by the ram 80 is sufficient to compress the freshly dug heavy textured clay soil into a hard adobe block without mixing the soil with a binder material or the addition of moisture thereto. Then, the latch pin 74 is retracted radially outwardly and the motor 62 is again actuated to angularly displace the table 40 an additional 90° to bring the third cavity into registry with the chamber 108 and to move the second dirt filled cavity into registry with the head 86. The process is then repeated and the table 40 is again angularly displaced 90° to position the first soil filled cavity 52 (which now contains a vertically compressed adobe block) into registry with the ejection head. At this time, the ram 96 is actuated to downwardly displace the adobe block onto the endless conveyor 118 by which it is conveyed to its discharge end. Of course, the rams 80 and 96 are simultaneously operated. The plate 122 which underlies the cavity 52 registered with the cavity 108 extends counterclockwise about the orbital path of the table 40 to the plate 60 and thereby retains the dirt in a freshly filled cavity 52 until that cavity can be registered with the head 86. Of course, after the soil within the cavity 52 registered with the head 86 is vertically compressed, it is radially expanded into tight frictional engagement with the inner surfaces of the corresponding sleeve 50 whereby the adobe block thus formed will be retained in that cavity until the cavity is registered with the ejection head 92 and ejected from the cavity by the head 92. Further, suitable automatic controls for sensing the amount of dirt within the chamber 108 may be provided for effecting automatic operation of the motor 62 and the rams 80 and 96 as well as the latch assembly 72 in proper timed sequence.

It is further to be noted that although it is preferable that building blocks be formed of heavy textured clay soil, other types of soil, including those consisting of a major portion of sand, may be used in forming building blocks.

Immediately after a building block 124 has been discharged from the conveyor 118, it may be placed in its position in a course of blocks being used to form a building wall. After a course of blocks has been laid, the upper surfaces of the last laid course of blocks may be sprayed with water so as to be slightly moistened and the next course of blocks may be applied to the wall. There is no need for the blocks 124 to be air-dried after having been formed. Accordingly, when forming an adobe wall consecutive blocks are laid end-to-end in order to form a first course of blocks and thereafter the upper surfaces of the last laid course of blocks are dampened with water and the next course of blocks is immediately applied thereover. The moistening of the upper layer of the last laid course of blocks forms a bond with the next layer course of blocks which is sufficient to retain the course of blocks in position relative to each other. Further, through the utilization of high pressure applied by the ram assembly 80, freshly dug soil may be utilized to form high quality building blocks at mass production rates.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An apparatus for forming building blocks from freshly dug soil, said apparatus including a frame, a rotary table journaled from said frame for intermittent angular displacement about an upstanding axis and defining at least three peripherally spaced open-ended vertically extending sleeve-type cavities spaced equally radially outwardly from said axis, said frame defining first soil receiving, second pressure head and third ejection head stations spaced about said axis and with which said cavities are successively registrable, said soil receiving station being adapted to receive freshly dug soil and opening downwardly for discharging soil therefrom into cavities of said table successively registered therewith, said pressure head station including downwardly facing pressure head means displaceable downwardly into a cavity of said table for vertically compressing the soil therein and said ejection head station including a vertically shiftable ejection head for ejecting a compressed soil block from a cavity of said table registered therewith, said frame including a pair of long, parallel and edge upstanding horizontally elongated front and rear plate means, a pair of short, parallel and edge upstanding horizontally elongated side plate means extending and secured between corresponding ends of said long plate means, and long plate means defining horizontally elongated and registered openings extending therethrough centrally intermediate the upper and lower extremities of said long plate means, a horizontally elongated bracing bar extending and secured between said long plate means centrally intermediate the opposite ends thereof and at least generally horizontally registered with the lower marginal portions of said openings, combined thrust and journal bearing means supported from a mid-length portion of said bar and journaling said rotary table from said frame, diametrically opposite peripheral portions of said table projecting outwardly through said openings, said short plate means being disposed outwardly of diametrically opposite peripheral portions of said rotary table, the spacing between the remote sides of said long plate means being no more than twice the radial spacing of said cavities outward from the axis of rotation of said rotary table, horizontal plate means disposed at and extending along an arcuate path extending between said first and second stations and defining a bottom for said cavities disposed at and moving between said first and second stations, said second and third stations being disposed diametrically opposite each other relative to the axis of rotation of said table and between corresponding end portions of said long plate means, and first station being disposed outwardly of one of said long plates and generally equally angularly spaced between said second and third stations relative to the axis of rotation of said table, said second station including a pair of laterally spaced apart horizontal support plates extending and secured between said long plate means and spaced below said opening means, a horizontal backing plate overlying and supported from said support plates and including an upper surface substantially horizontally registered with said openings.

2. The apparatus of claim 1 wherein said frame includes a wheeled chassis.

3. The apparatus of claim 2 wherein said wheeled chassis comprises a trailer frame.

4. The apparatus of claim 1 wherein said cavities equal four in number and are angularly displaced 90° apart about said axis.

5. The apparatus of claim 1 including motor means drivingly connected to said table for angularly displacing the latter relative to said frame, and coacting latch structure carried by said table and frame operative to releasably latch said table in successive 90° angularly displaced positions relative to said frame.

* * * * *